US012371914B2

(12) United States Patent
Wang

(10) Patent No.: US 12,371,914 B2
(45) Date of Patent: Jul. 29, 2025

(54) ONE-WAY RETRACTABLE BUILDING FORMWORK APPARATUS

(71) Applicant: Chien-Ho Wang, Taichung (TW)

(72) Inventor: Chien-Ho Wang, Taichung (TW)

( * ) Notice: Subject to any disclaimer, the term of this patent is extended or adjusted under 35 U.S.C. 154(b) by 312 days.

(21) Appl. No.: 18/095,404

(22) Filed: Jan. 10, 2023

(65) Prior Publication Data

US 2023/0265667 A1 Aug. 24, 2023

(30) Foreign Application Priority Data

Feb. 23, 2022 (TW) ..... 111106587

(51) Int. Cl.
*E04G 11/08* (2006.01)
*E04G 9/08* (2006.01)

(52) U.S. Cl.
CPC ..... *E04G 9/08* (2013.01); *E04G 11/082* (2013.01)

(58) Field of Classification Search
CPC ..... E04G 11/06; E04G 11/08; E04G 11/082; E04G 9/08; E04G 9/083
See application file for complete search history.

(56) References Cited

U.S. PATENT DOCUMENTS 2,658,252 A * 11/1953 Avril ..... E04G 15/02 249/35
2,818,627 A * 1/1958 Blasius ..... B28B 7/22 249/153
3,894,711 A * 7/1975 Van der Lely ..... E04G 11/10 249/185
4,055,321 A * 10/1977 Schimmel ..... B28B 7/22 249/185
4,250,989 A * 2/1981 Grundken ..... B65G 19/22 198/842
4,465,257 A * 8/1984 Schimmel ..... E04G 11/02 249/185
4,520,988 A * 6/1985 Walker ..... E04G 11/082 249/185

(Continued)

FOREIGN PATENT DOCUMENTS

CN 106088573 A 11/2016
CN 110630016 A 12/2019

(Continued)

OTHER PUBLICATIONS

Search Report appended to an Office Action, which was issued to Taiwanese counterpart application No. 111106587 by the TIPO on Jun. 30, 2022, with an English translation thereof.

(Continued)

*Primary Examiner* — Kyle J. Walraed-Sullivan
(74) *Attorney, Agent, or Firm* — DLA PIPER LLP (US); Blake W. Jackson

(57) ABSTRACT

A one-way retractable building formwork apparatus for mounting on a mounting surface of a substrate module includes a first side bar disposed on one end of the mounting surface that extends along a lateral direction, a second side bar disposed on another end of the mounting surface and opposite to the first side bar along an extending direction transverse to the lateral direction, and a retractable unit that is disposed on the mounting surface, that is connected to the first side bar, and that is extendable along the extending direction to fixedly connect to the second side bar.

8 Claims, 17 Drawing Sheets

(56) References Cited

U.S. PATENT DOCUMENTS

| | | | | | |
|---|---|---|---|---|---|
| 4,707,925 | A * | 11/1987 | Englehart | ..... | B25H 7/00<br>33/562 |
| 2011/0278432 | A1 * | 11/2011 | Sollars | ..... | E04G 17/00<br>249/189 |

FOREIGN PATENT DOCUMENTS

| | | | | | |
|---|---|---|---|---|---|
| CN | 210369881 | | | 4/2020 | |
| CN | 210369881 | U | | 4/2020 | |
| CN | 210369882 | U | | 4/2020 | |
| CN | 111305553 | | | 6/2020 | |
| CN | 112727065 | A | * | 4/2021 | ..... E04G 9/02 |
| CN | 112900839 | A | * | 6/2021 | ..... E04G 17/00 |
| FR | 2692616 | A1 | * | 12/1993 | ..... E04G 11/082 |
| JP | S5069025 | U | | 6/1975 | |
| JP | H05125824 | A | | 5/1993 | |
| JP | H10131481 | A | | 5/1998 | |
| JP | 2002256700 | A | | 9/2002 | |
| KR | 100859534 | B1 | | 9/2008 | |
| WO | 2010088627 | A1 | | 8/2010 | |

OTHER PUBLICATIONS

Search Report issued to European counterpart application No. 23151152.8 by the EPO on Jul. 19, 2023 (8 pages).

* cited by examiner

ONE-WAY RETRACTABLE BUILDING FORMWORK APPARATUS

CROSS-REFERENCE TO RELATED APPLICATION

This application claims priority to Taiwanese Invention Patent Application No. 111106587, filed on Feb. 23, 2022.

FIELD

The disclosure relates to a building formwork, and more particularly to a one-way retractable building formwork apparatus.

BACKGROUND

An existing building formwork apparatus, as disclosed in Taiwanese Patent No. I716319, includes at least four formworks and at least one connecting hornbeam block. Each formwork has a mold surface at one side thereof, a mounting surface opposite to the mold surface, and two connecting posts disposed on upper and lower ends of the mounting surface. Each connecting post has a plurality of through holes. The connecting hornbeam block has a plurality of connecting holes.

After the formworks are brought to align with and abut against each other, the connecting hornbeam block is then disposed on the connecting posts of the formworks, after which a plurality of fasteners are extended through the through holes and the connecting holes to fix the formworks and the connecting hornbeam block, thereby forming the existing building formwork apparatus.

Grout is poured between two existing building formwork apparatuses to make a wall. Since the dimensions of the wall differ due to different engineering works, and since there is no way to have a standard building formwork apparatus available, assembly of the existing building formwork apparatuses may not conform to the desired dimensions of the wall to be made, so that it is necessary to customize the existing building formwork apparatus so as to conform to the desired dimensions of the wall to be constructed.

SUMMARY

Therefore, an object of the present disclosure is to provide a one-way retractable building formwork apparatus that can alleviate at least one of the drawbacks of the prior art.

According to one aspect of this disclosure, the one-way retractable building formwork apparatus for mounting on a mounting surface of a substrate module includes a first side bar configured to be disposed on one end of the mounting surface that extends along a lateral direction, a second side bar configured to be disposed on another end of the mounting surface that extends along the lateral direction and opposite to the first side bar along an extending direction transverse to the lateral direction, and a retractable unit configured to be disposed on the mounting surface and connected to the first side bar. The retractable unit is extendable along the extending direction to fixedly connect to the second side bar.

According to another aspect of this disclosure, the one-way retractable building formwork apparatus is configured for mounting on a substrate module which includes a first substrate and a second substrate adjacently connected to each other along an extending direction. The first substrate has a first surface. The second substrate has a second surface. The one-way retractable building formwork apparatus includes a first side bar configured to be disposed on one end of the first surface that extends along a lateral direction transverse to the extending direction, a second side bar configured to be disposed on one end of the second surface that extends along the lateral direction and opposite to the first side bar along the extending direction, and a retractable unit configured to be disposed on the first surface and connected to the first side bar. The retractable unit is extendable along the extending direction to fixedly connect to the second side bar.

BRIEF DESCRIPTION OF THE DRAWINGS

Other features and advantages of the disclosure will become apparent in the following detailed description of the embodiments with reference to the accompanying drawings. It is noted that various features may not be drawn to scale.

DETAILED DESCRIPTION

Figure 1:
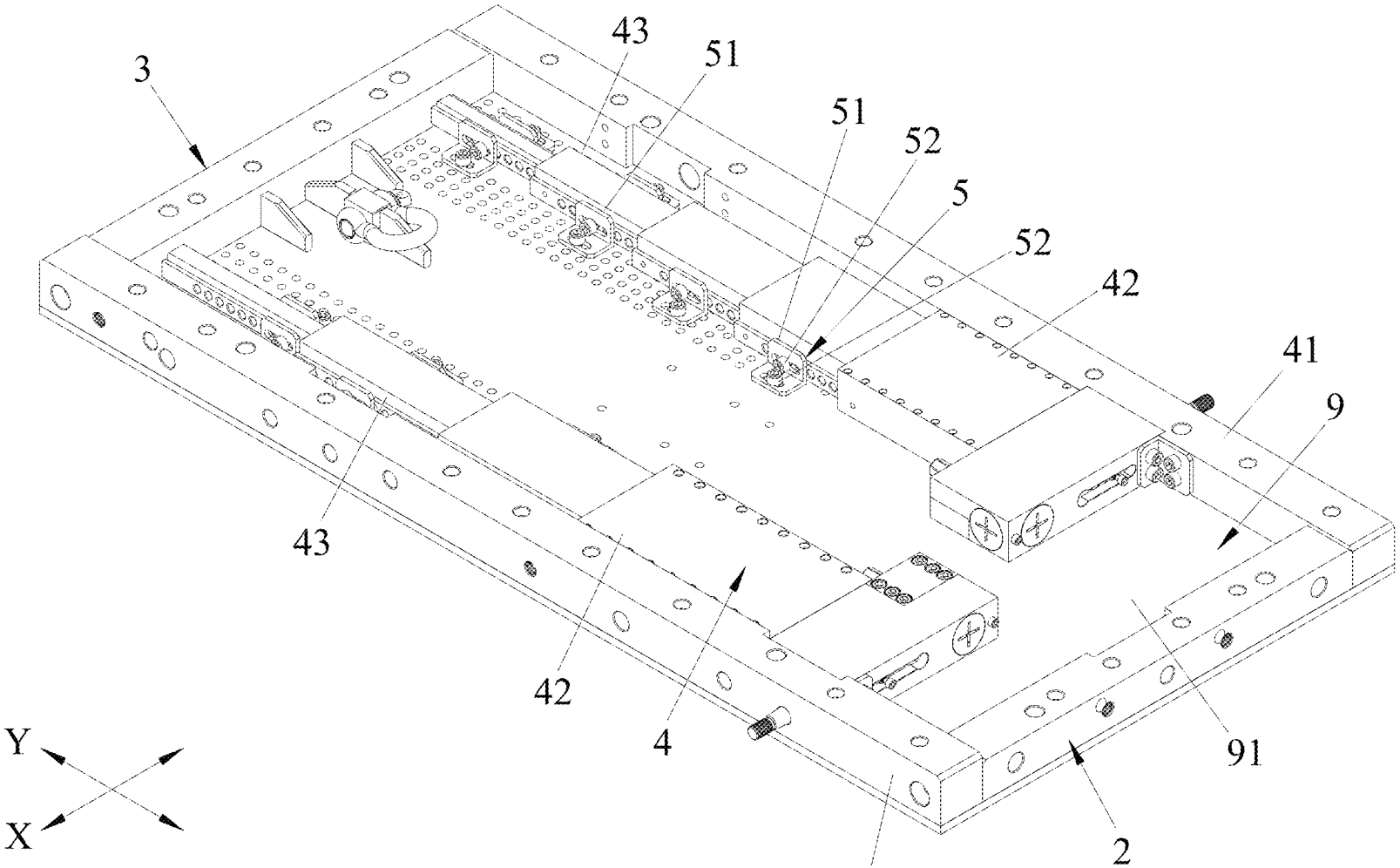
FIG. 1 is a perspective view of a one-way retractable building formwork apparatus according to the first embodiment of the present disclosure.
Figure 2:
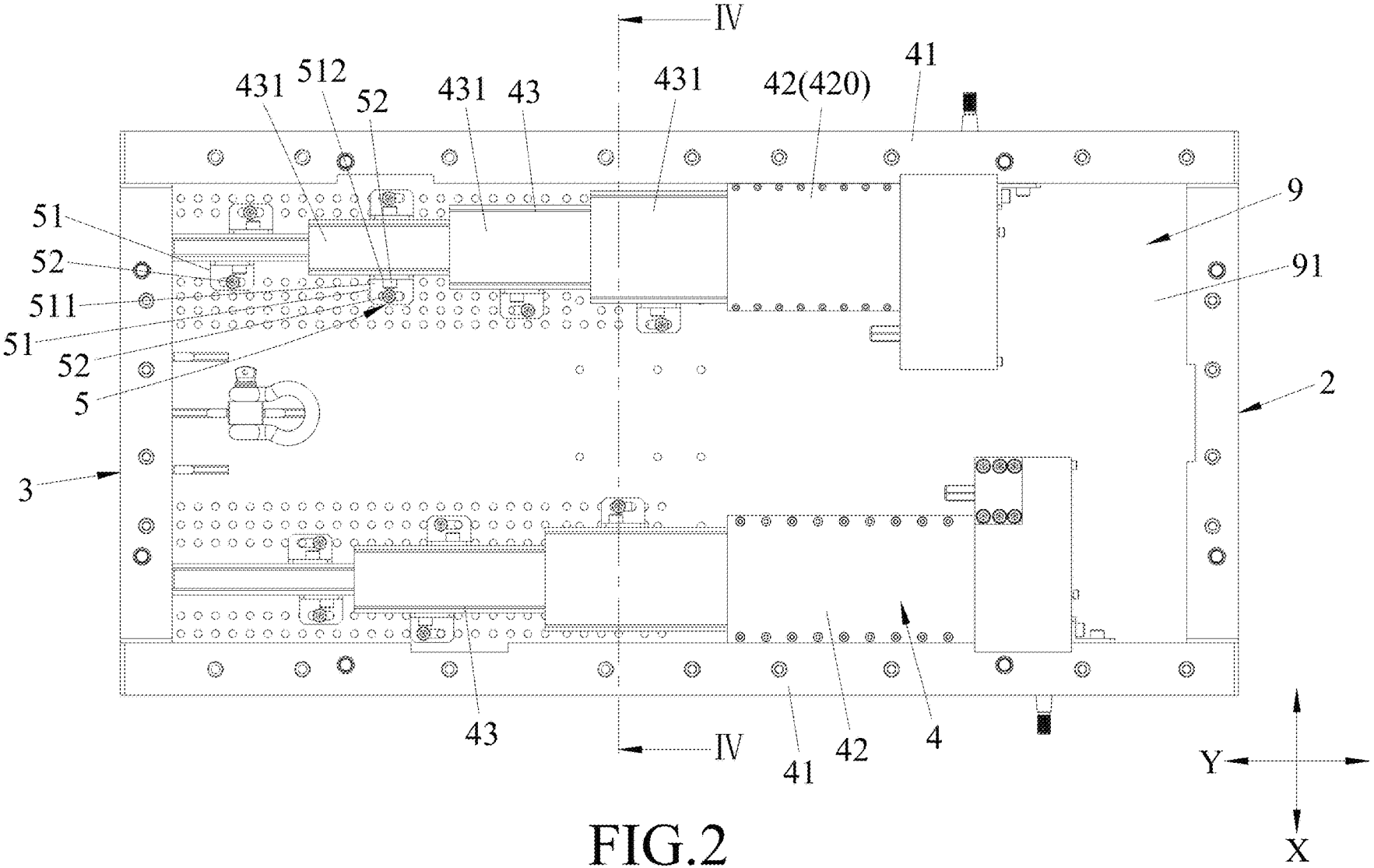
FIG. 2 is a schematic top view of the first embodiment.
Figure 3:
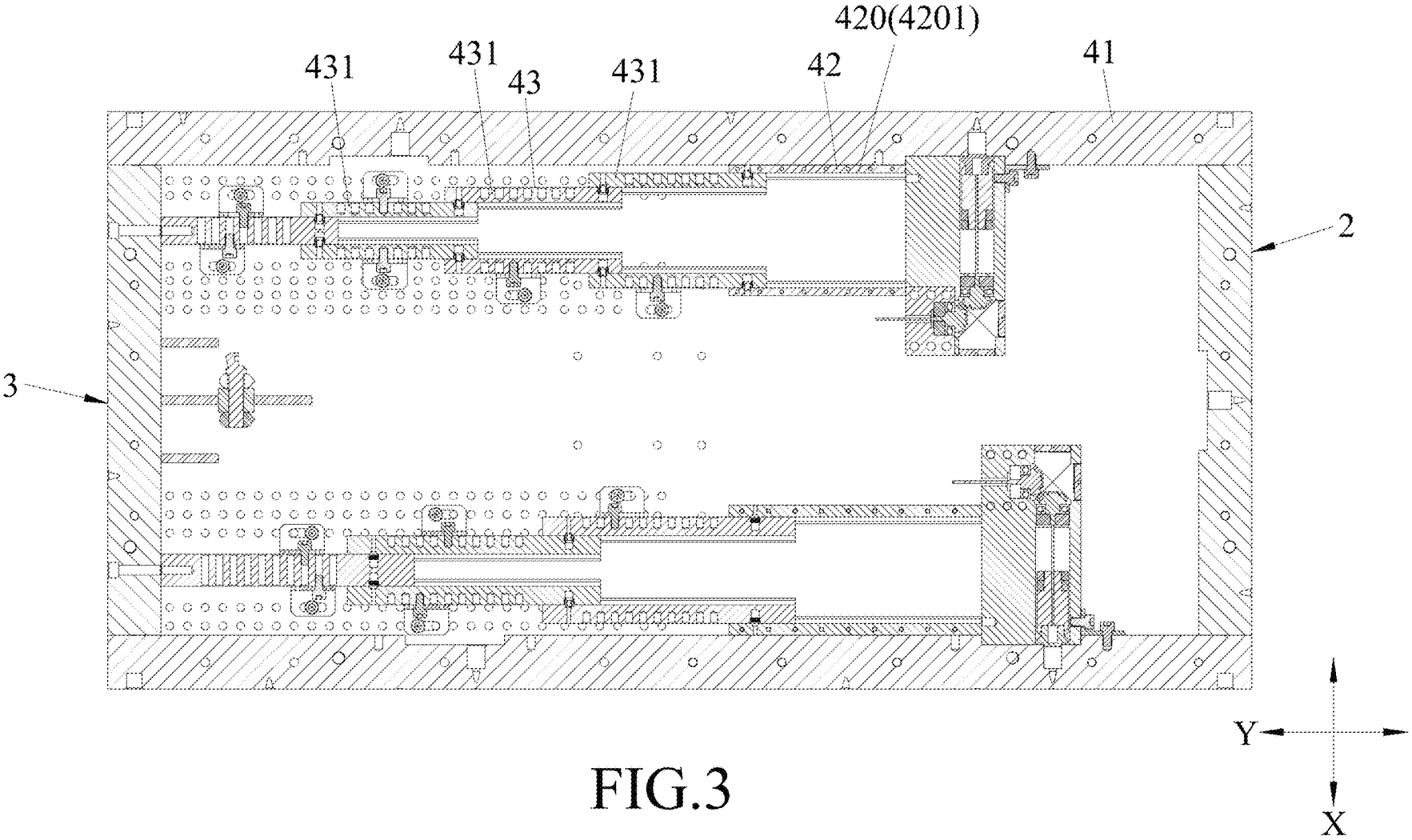
FIG. 3 is a sectional top view of the first embodiment.
Figure 4:
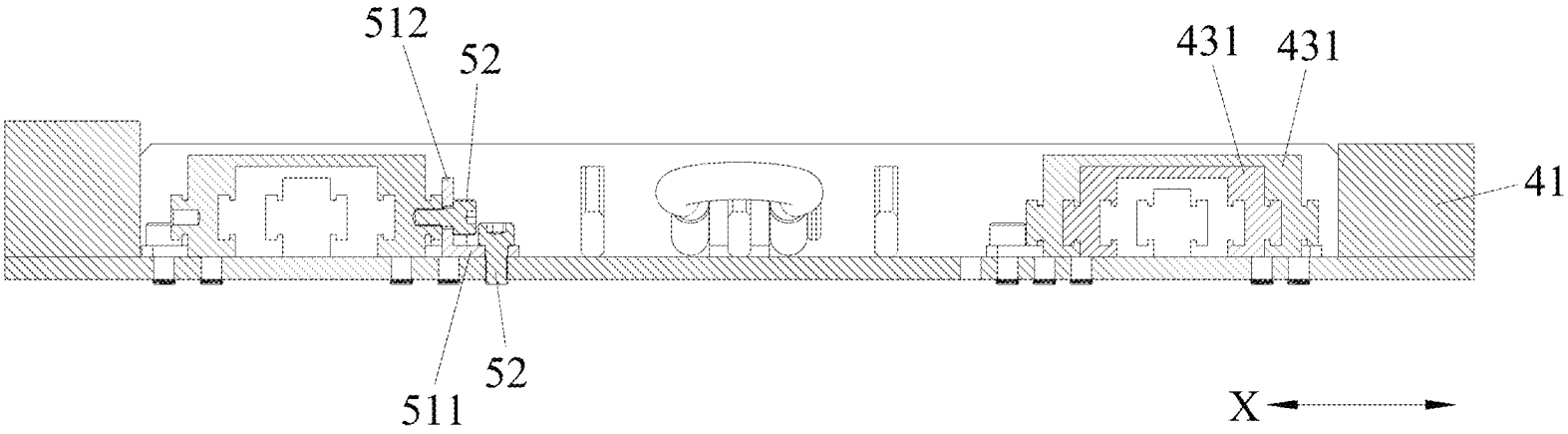
FIG. 4 is a sectional view taken along line IV-IV of FIG. 2.
Figure 5:
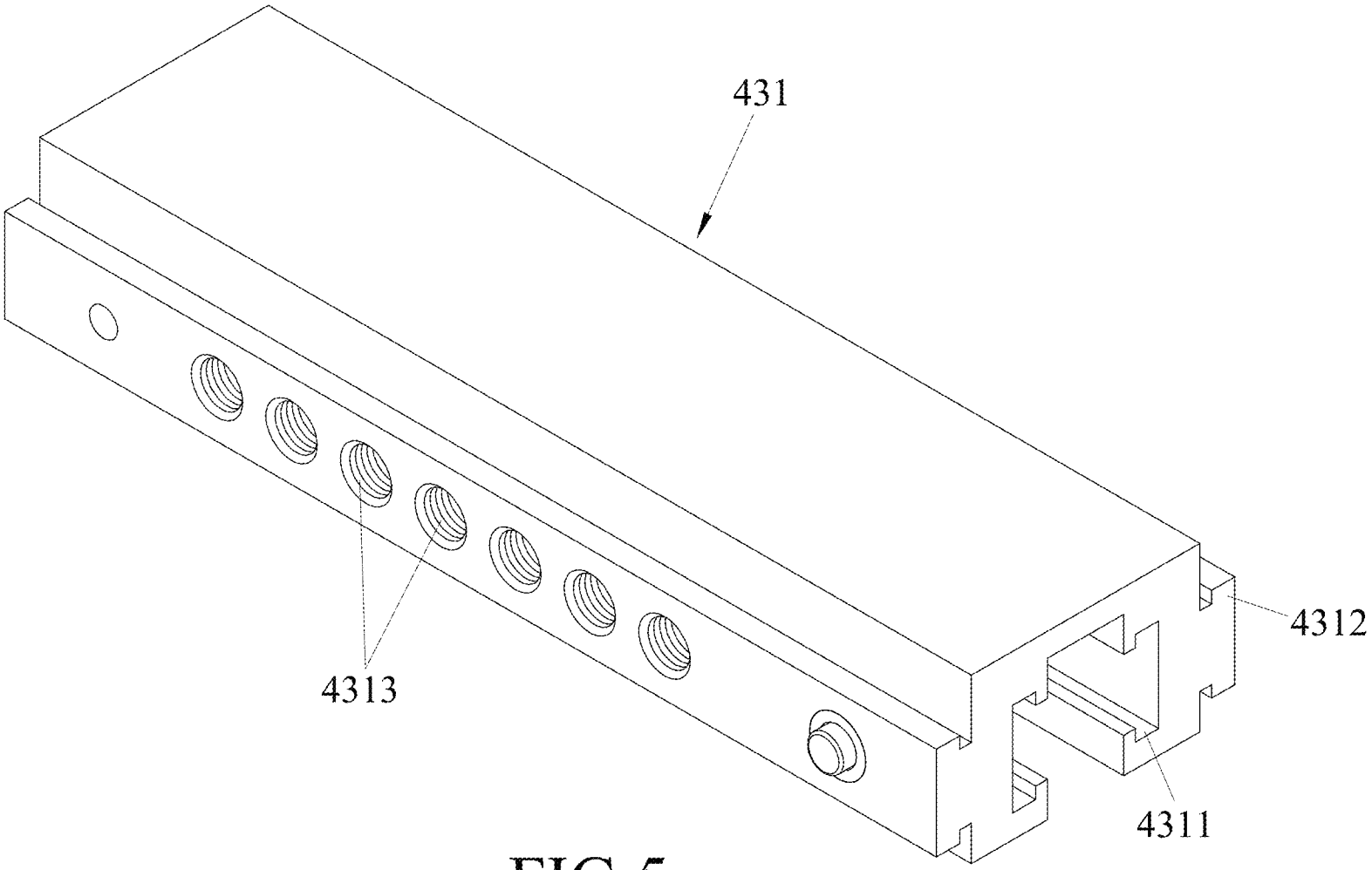
FIG. 5 is a perspective view of a side plate of a side plate assembly of the first embodiment.

Before the disclosure is described in greater detail, it should be noted that where considered appropriate, reference numerals or terminal portions of reference numerals have been repeated among the figures to indicate corresponding or analogous elements, which may optionally have similar characteristics.

Referring to FIGS. 1 to 5, a one-way retractable building formwork apparatus according to the first embodiment of the present disclosure is configured to be mounted on a mounting surface 91 of a substrate module 9, and includes a first side bar 2, a second side bar 3, a retractable unit 4 and a side connection unit 5.

The first side bar 2 is disposed on one end of the mounting surface 91 that extends along a lateral direction (X). The second side bar 3 is disposed on another end of the mounting surface 91 that extends along the lateral direction (X), and is opposite to the first side bar 2 along an extending direction (Y) transverse to the lateral direction (X). The retractable unit 4 is disposed on the mounting surface 91, is connected to the first side bar 2, and is extendable along the extending direction (Y) to fixedly connect to the second side bar 3.

In this embodiment, the retractable unit 4 includes two side bar modules 41, two fixed plate assemblies 42, and two side plate assemblies 43. The side bar modules 41 extend along the extending direction (Y), and are disposed on another two opposite ends of the mounting surface 91 that extend along the extending direction (Y) such that the side bar modules 41 are opposite to each other along the lateral direction (X). The side bar modules 41 are fixedly connected to two opposite ends of the first side bar 2. The fixed plate assemblies 42 are disposed on the mounting surface 91 between the first and second side bars 2, 3. The side plate assemblies 43 are respectively inserted into the fixed plate assemblies 42, and are extendable out of the same along the extending direction (Y) to fixedly connect to the second side bar 3.

For the convenience of description, only one of the fixed plate assemblies 42 and the corresponding side plate assembly 43 will be described below.

With reference to FIGS. 2 to 5, the fixed plate assembly 42 includes a guide fixed plate 420 having a pair of inner rails 4201. In this embodiment, each inner rail 4201 is in the form of a groove having a T-shaped cross section, but is not limited thereto. The side plate assembly 43 includes a plurality of side plates 431 telescopically connected to one another. An outermost one of the side plates 431 is slidably inserted into the guide fixed plate 420; and, an innermost one of the side plates 431 is slidably engaged with and is extendable out of an adjacent one of the side plates 431 to fixedly connect to the second side bar 3. Each side plate 431 has a pair of inner rails 4311 extending along a length thereof, and a pair of outer rails 4312 opposite to the pair of inner rails 4311 and extending also along the length thereof. In this embodiment, each inner rail 4311 is in the form of a groove having a T-shaped cross section, while each outer rail 4312 is in the form of a protrusion having a T-shaped cross section, but not limited thereto.

The pair of the outer rails 4312 of the outermost side plate 431 are slidably engaged with the pair of the inner rails 4201 of the guide fixed plate 420 to limit the outermost side plate 431 to adjust the position thereof only along the extending direction (Y). The pair of the outer rails 4312 of one of each two adjacent ones of the side plates 431 are slidably engaged with the pair of the inner rails 4312 of the other side plate 431 to limit the one of each two adjacent side plates 431 to adjust the position thereof only along the extending direction (Y). Each outer rail 4312 of each side plate 431 is provided with a plurality of threaded holes 4313 spacedly arranged along the length thereof.

The side connection unit 5 includes a plurality of side connectors 51 and a plurality of fixing screws 52. Each side connector 51 includes a base plate 511 disposed on the mounting surface 91, and a vertical plate 512 extending upwardly from one end of the base plate 511 and adjacent to a respective one of the side plates 431. Some of the fixing screws 52 are respectively inserted through elongated holes in the base plates 511 of the side connectors 51 to fix the base plates 511 to the mounting surface 91. Each of the other ones of the fixing screws 52 is inserted through an elongated hole in a respective one of the vertical plates 512 of the side connectors 51 and is threadedly connected to a selected one of the threaded holes 4313 in a respective one of the side plates 431 to fix each vertical plate 512 to the respective side plate 431 along the lateral direction (X).

In use, a plurality of basic building formworks (not shown) having fixed dimensions are first made according to a wall to be constructed, and then, according to the length difference between an assembly of the basic building formworks and the wall to be constructed, the substrate module 9 that meets the length difference is further manufactured.

Next, based on the dimensions of the substrate module 9, the first side bar 2, the second side bar 3 and the side bar modules 41 corresponding to the dimensions of the substrate module 9 are fixedly connected to the mounting surface 91 of the substrate module 9 through a plurality of screws, and the first side bar 2 is fixed between the side bar modules 41 through a plurality of screws. Afterwards, the fixed plate assembly 42 is also fixed to the mounting surface 91 through a plurality of screws, and the side plates 431 inside the guide fixed plate 420 of the fixed plate assembly 42 are pulled out toward the second side bar 3 along the extending direction (Y) to fix the innermost side plate 431 to the second side bar 3 through a plurality of screws. Finally, the side plates 431 are fixed to their respective positions through the side connectors 51 and the fixing screws 52, thereby achieving the effect of strengthening the substrate module 9. Since the side plates 431 are retractable relative to the guide fixed plate 420, they are suitable for use in different dimensions of the substrate module 9.

After the components of the one-way retractable building formwork apparatus of this disclosure are assembled to the substrate module 9, the one-way retractable building formwork apparatus of this disclosure together with the substrate module 9 is then assembled to the basic building formworks so as to meet the dimensions of the wall to be constructed, thereby saving the labor cost.

Figure 6:
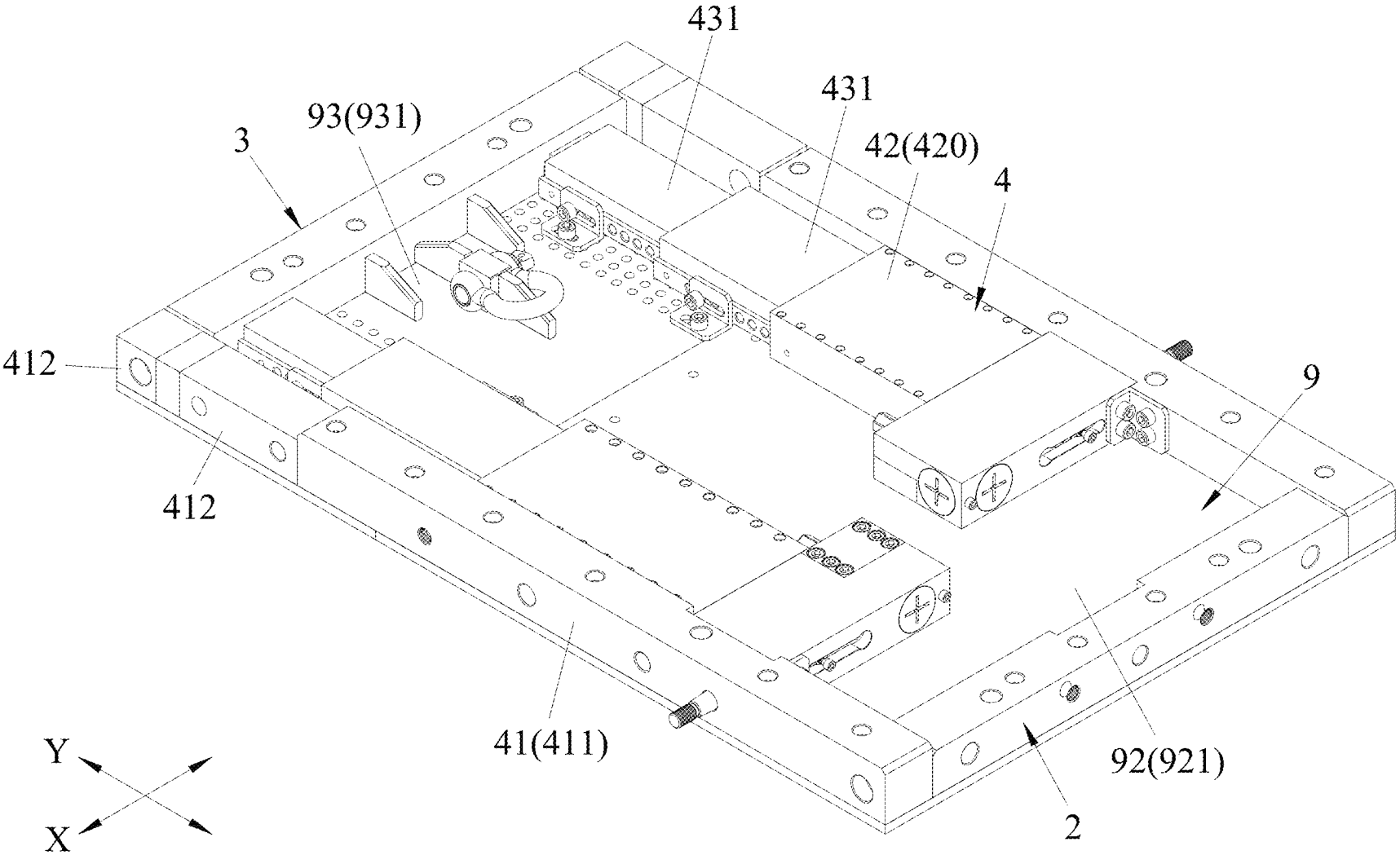
FIG. 6 is a perspective view of a one-way retractable building formwork apparatus according to the second embodiment of this disclosure.
Figure 7:
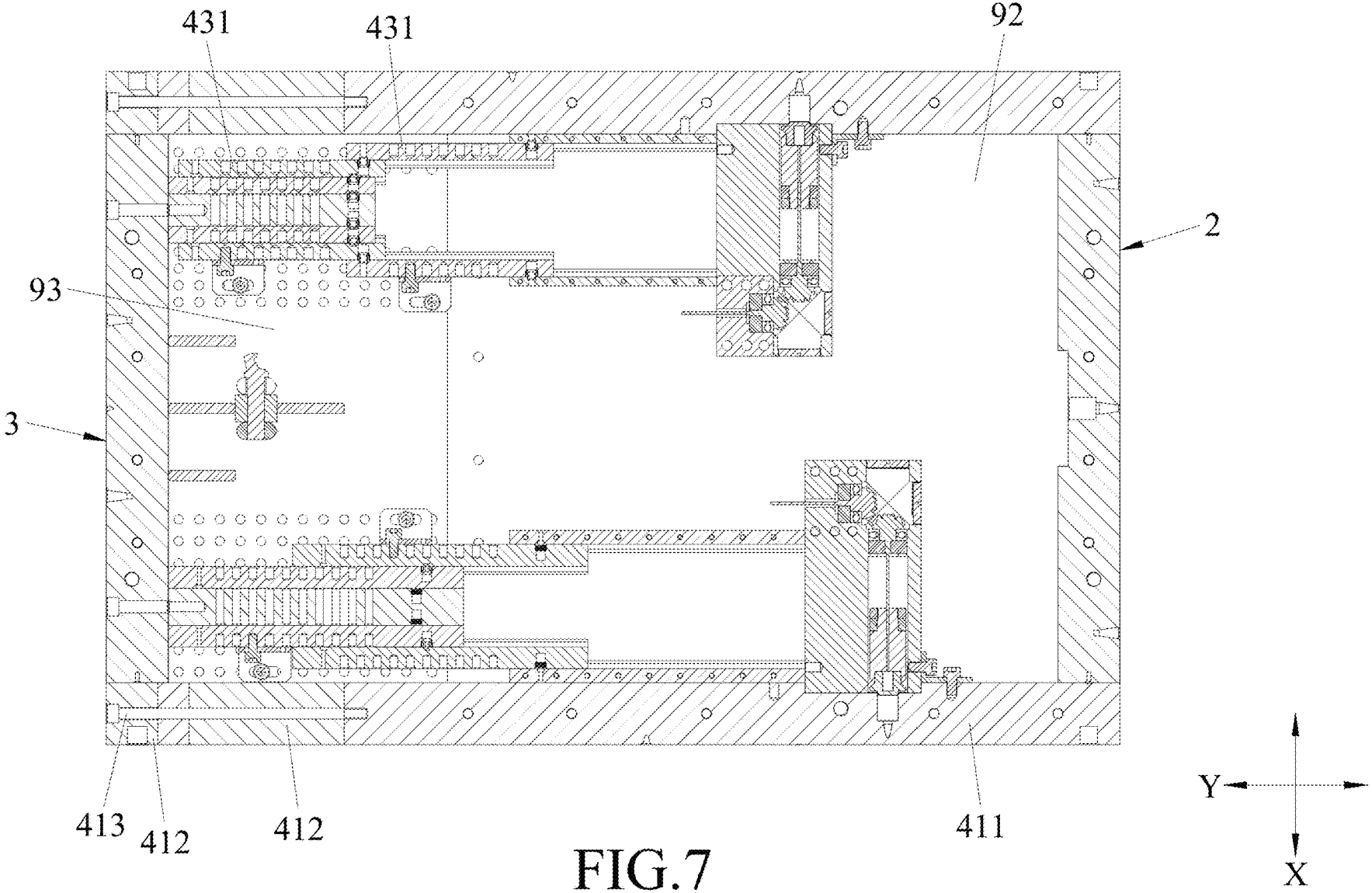
FIG. 7 is a sectional top view of the second embodiment.
Figure 8:
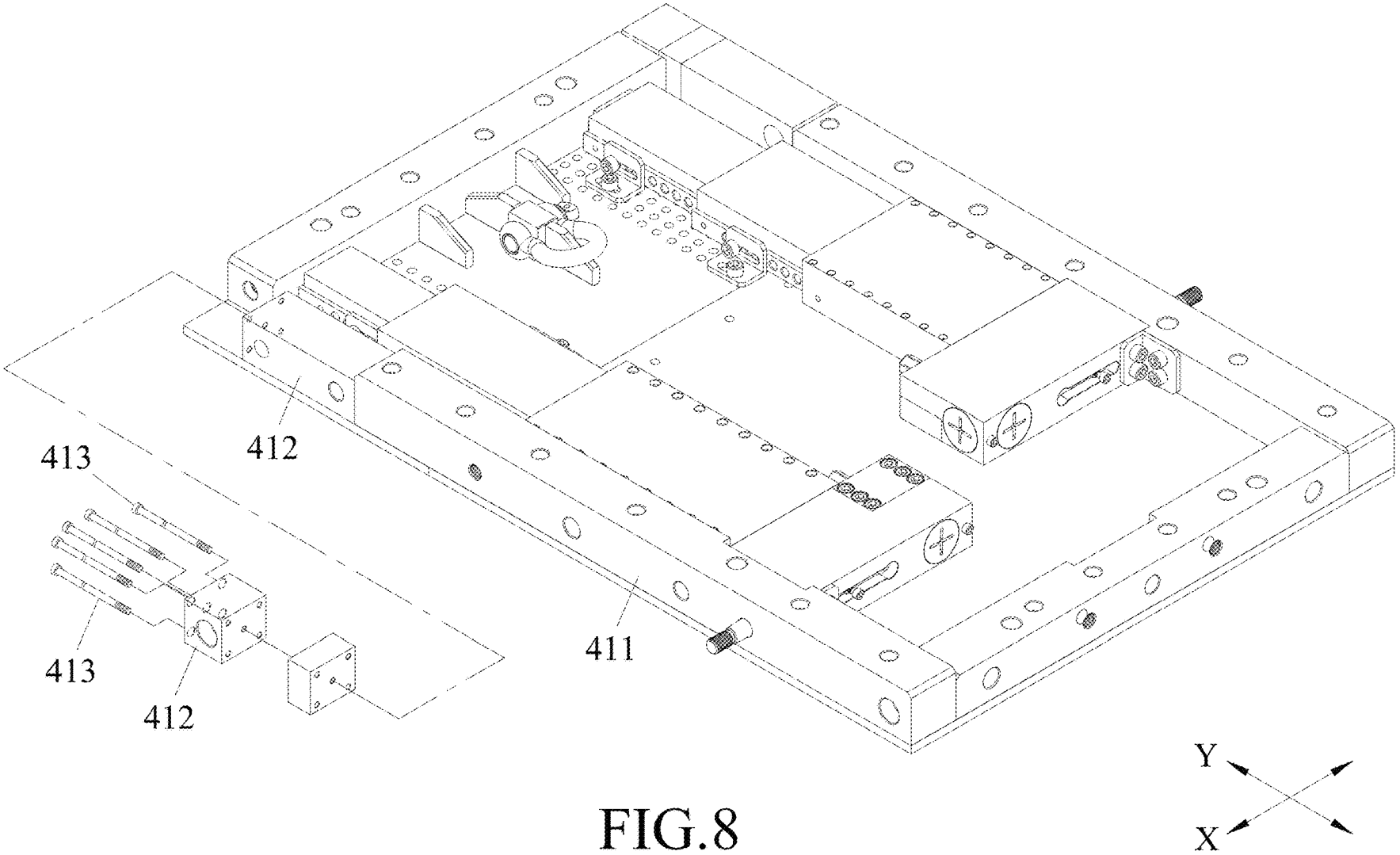
FIG. 8 is a partly exploded perspective view of the second embodiment.

Referring to FIGS. 6 to 8, a one-way retractable building formwork apparatus according to the second embodiment of this disclosure is shown to be identical to the first embodiment, but differs in that, in the second embodiment, the substrate module 9 includes a first substrate 92 and a second substrate 93 adjacently connected to each other along the extending direction (Y). The first substrate 92 has a first surface 921, while the second substrate 93 has a second surface 931 in the same direction as the first surface 921. The first side bar 2 is disposed on one end of the first surface 921 that extends along the lateral direction (X) and that is distal to the second surface 931. The second side bar 3 is disposed on one end of the second surface 931 that extends along the lateral direction (X) and that is opposite to the first side bar 2 along the extending direction (Y). The retractable unit 4 is disposed on the first surface 921, and is retractably connected to the second side bar 3. In this embodiment, the first substrate 92 is made of a material having fixed dimensions, while the second substrate 93 is made of a leftover material from the previous projects, but not limited thereto. That is, the first and second substrates 92, 93 may both be made of the leftover materials.

Further, the innermost side plate 431 and the side plate 431 immediately adjacent thereto are not extended out of the guide fixed plate 420 of the fixed plate assembly 42.

Moreover, each side bar module 41 includes a main side bar 411 extending the extending direction (Y) and fixedly connected to one end of the first side bar 2, three extension side bars 412 sequentially arranged along the extending direction (Y), and five side bar screws 413 inserted through the extension side bars 412 along the extending direction (Y) and screwed to the main side bar 411 to thereby connect the extension side bars 412 to the main side bar 411. The longest one of the extension side bars 412 is disposed immediately adjacent to the main side bar 411 at a side opposite to the first side bar 2. In this embodiment, the main side bar 411 is made of a material having fixed dimensions, while the extension side bars 412 are made of leftover materials from the previous projects, but not limited thereto. That is, the main side bar 411 and the extension side bars 412 may all be made of the leftover materials. However, in other variations, the extension side bars 412 may be directly fixed to the second surface 931 using the side bar screws 413, and the side bar screws 413 may not be limited to extend through the extension side bars 412 along the extending direction (Y), but may extend through the extension side bars 412 in a direction transverse to the extending direction (Y) and the lateral direction (X) to similarly achieve the fixing effect.

Therefore, the second embodiment can achieve the same effect as that of the first embodiment. Further, since the substrate module 9 can be formed by splicing multiple substrates and the side bar modules 41 can also be formed by splicing multiple extension side bars, different lengths of the substrate module 9 and the side bar modules 41 can thus be made.

Figure 9:
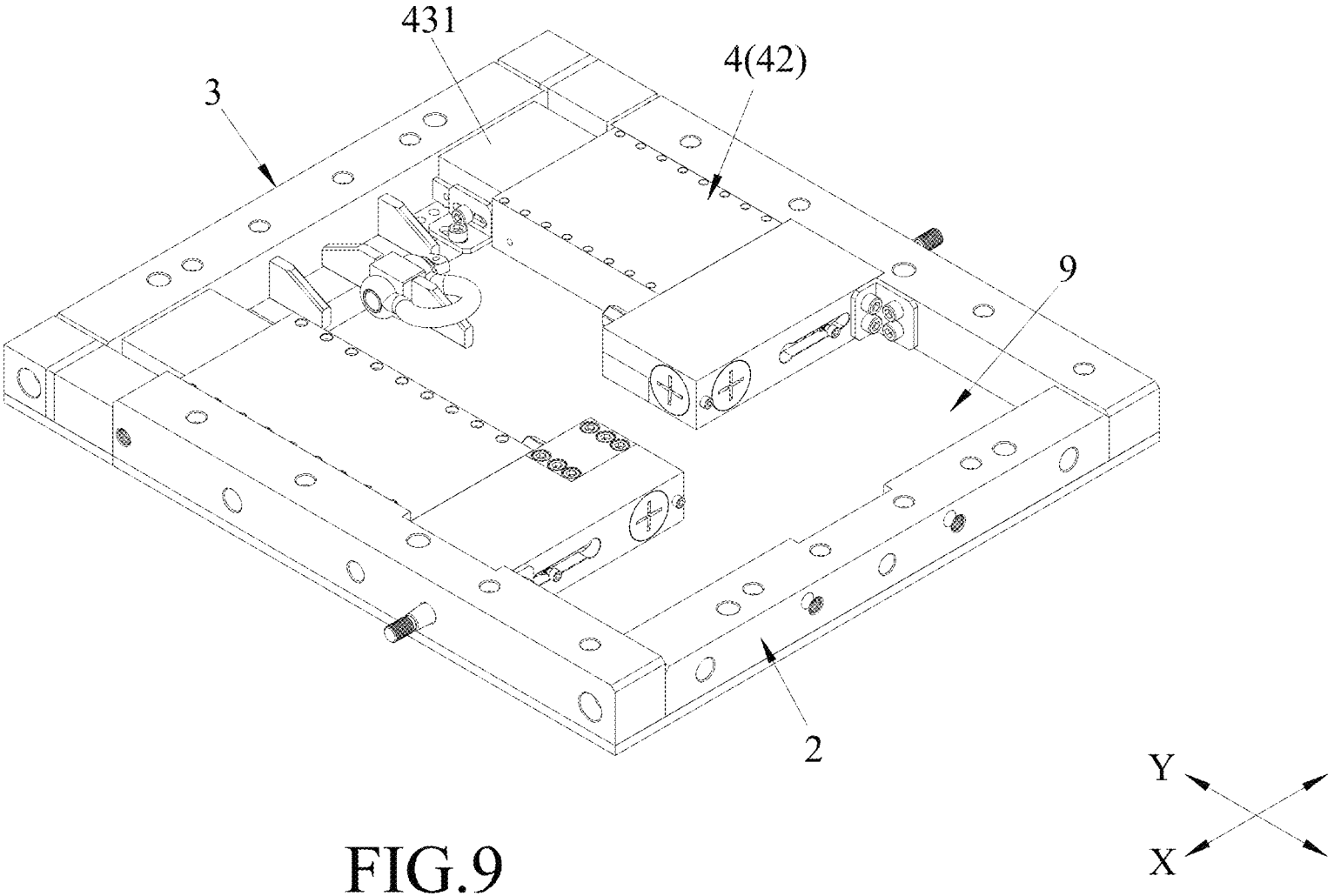
FIG. 9 is a perspective view of a one-way retractable building formwork apparatus according to the third embodiment of this disclosure.
Figure 10:
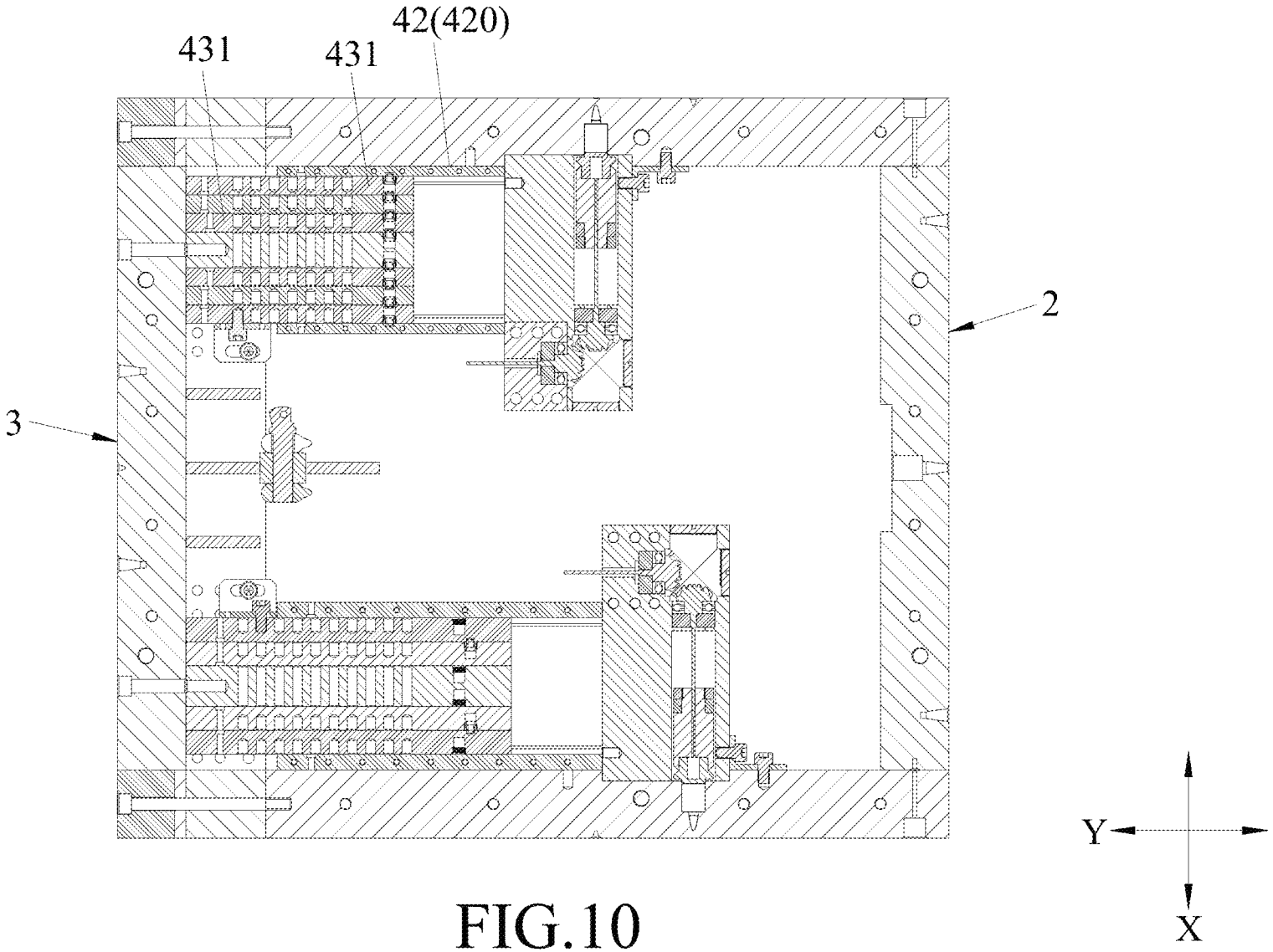
FIG. 10 is a sectional top view of the third embodiment.

Referring to FIGS. 9 and 10, a one-way retractable building formwork apparatus according to the third embodiment of this disclosure is shown to be identical to the second embodiment, but differs in that only the outermost side plate 431 is partially extended out of the guide fixed plate 420 of the fixed plate assembly 42 of the retractable unit 4. The third embodiment can achieve the same effect as that of the second embodiment, and is suitable for use with the substrate module 9 having a short length along the extending direction (Y).

Figure 11:
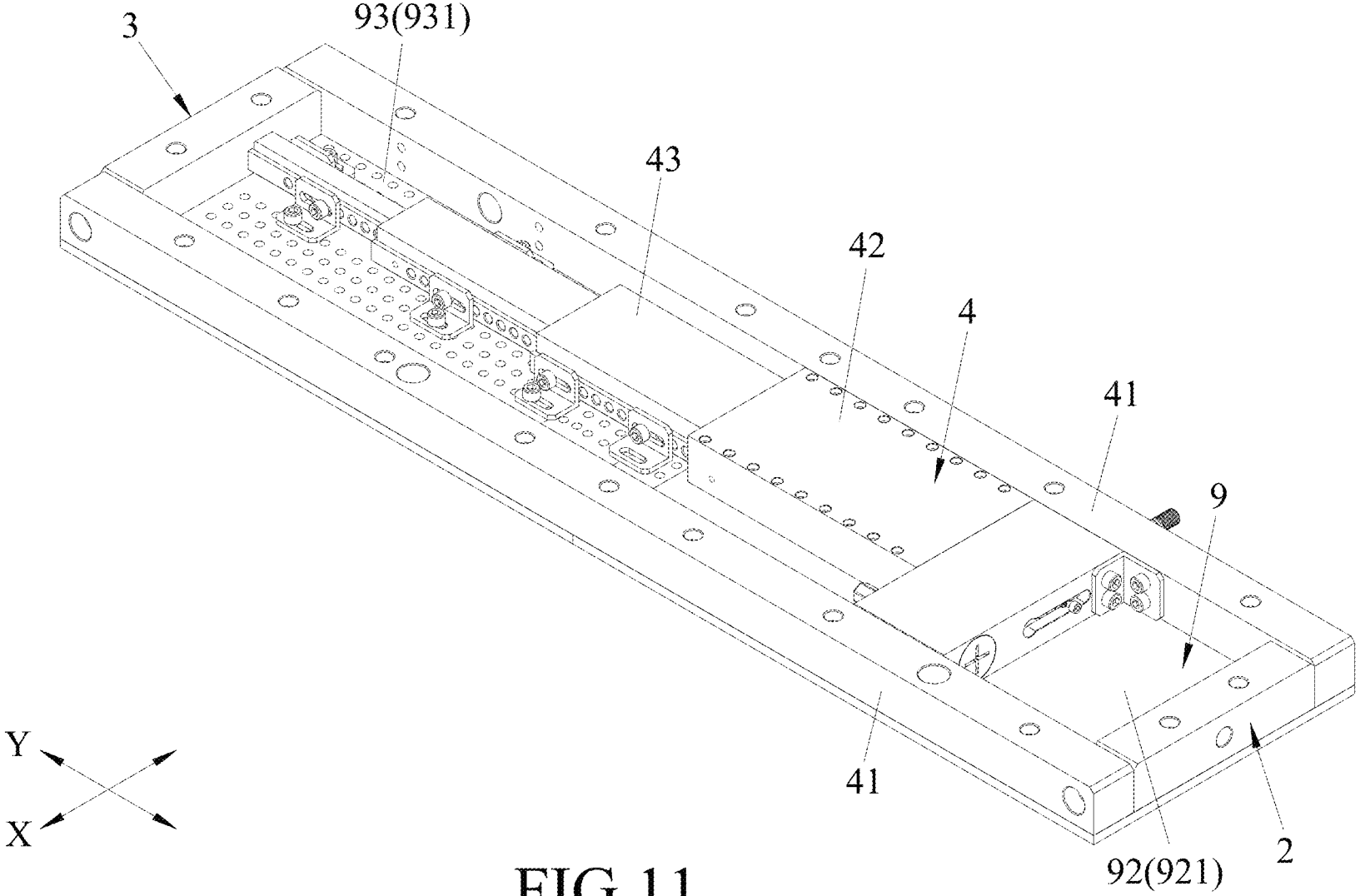
FIG. 11 is a perspective view of a one-way retractable building formwork apparatus according to the fourth embodiment of this disclosure.

Referring to FIG. 11, a one-way retractable building formwork apparatus according to the fourth embodiment of this disclosure is shown to be identical to the first embodiment, but differs in that, in the fourth embodiment, the substrate module 9 includes a first substrate 92 and a second substrate 93 adjacently connected to each other along the extending direction (Y). The first substrate 92 has a first surface 921, while the second substrate 93 has a second surface 931 in the same direction as the first surface 921. The first side bar 2 is disposed on one end of the first surface 921 that extends along the lateral direction (X) and that is distal to the second surface 931. The second side bar 3 is disposed on one end of the second surface 931 that extends along the lateral direction (X) and that is opposite to the first side bar 2 along the extending direction (Y).

The retractable unit 4 is disposed on the first surface 921, and is retractably connected to the second side bar 3. In this embodiment, the retractable unit 4 includes the two side bar modules 41, but only one fixed plate assembly 42 and only one side plate assembly 43. The fourth embodiment can achieve the same effect as that of the first embodiment, and is suitable for use with the substrate module 9 having a short length along the lateral direction (X).

Figure 12:
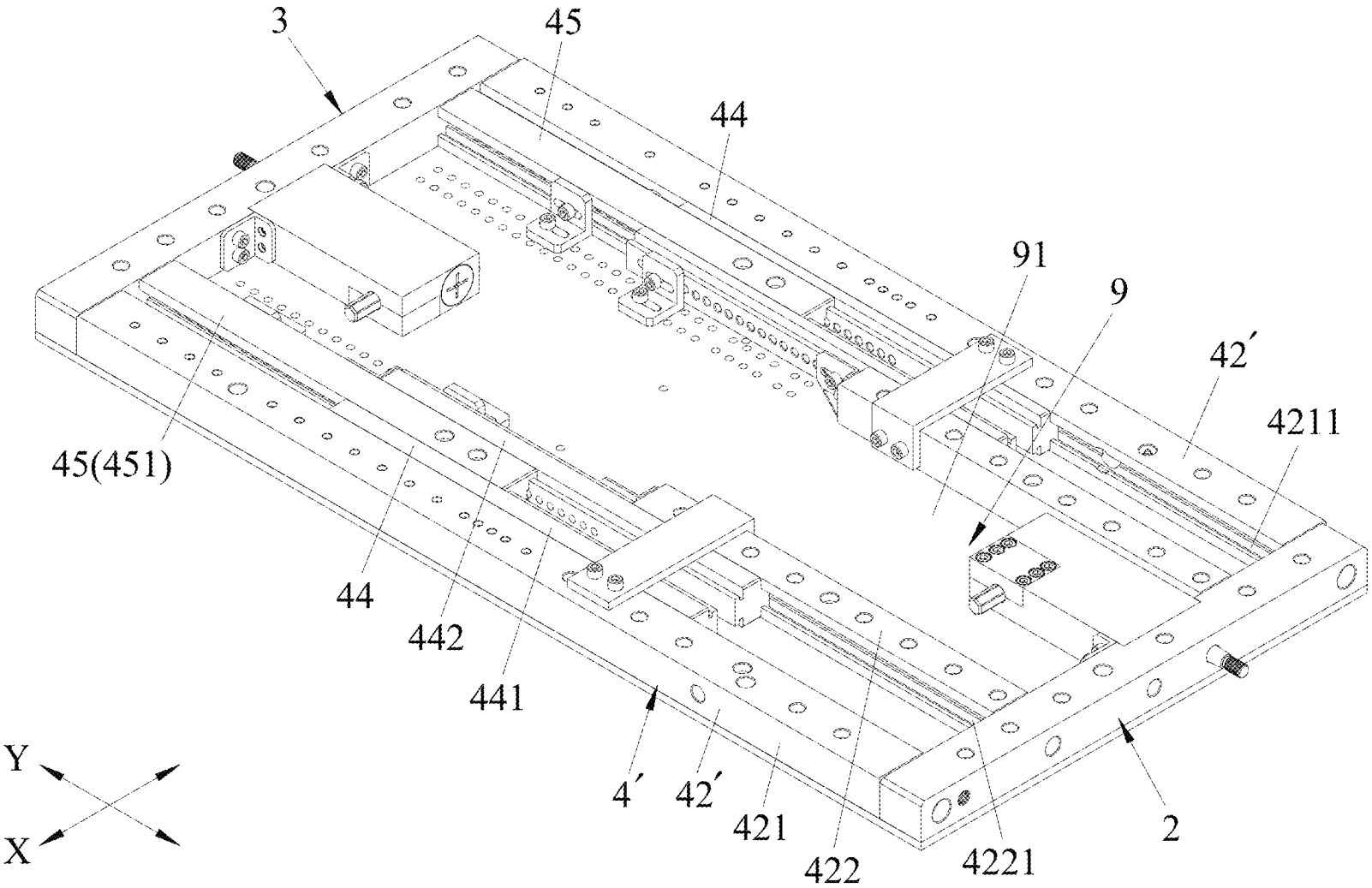
FIG. 12 is a perspective view of a one-way retractable building formwork apparatus according to the fifth embodiment of this disclosure.
Figure 13:
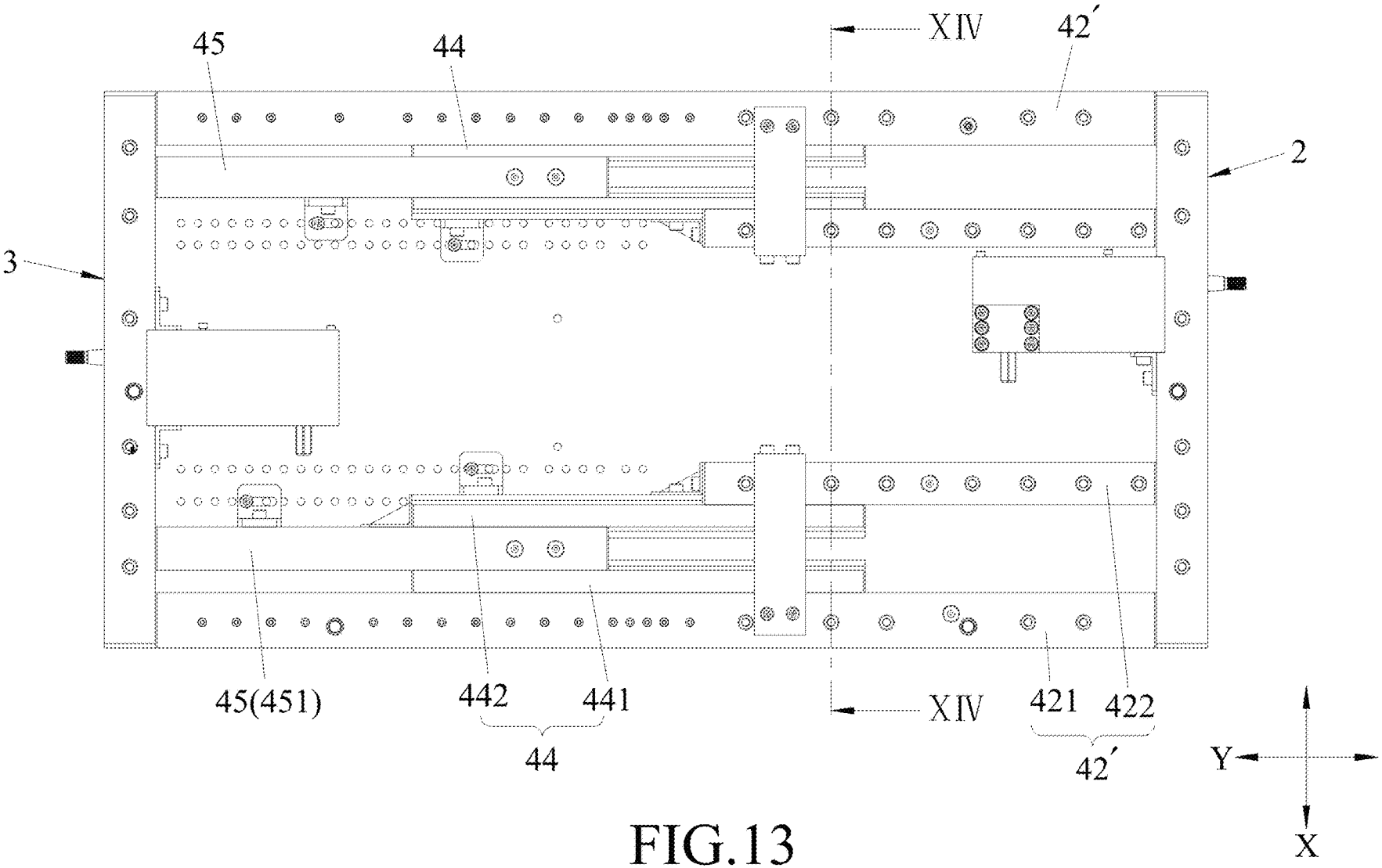
FIG. 13 is a sectional top view of the fifth embodiment.
Figure 14:
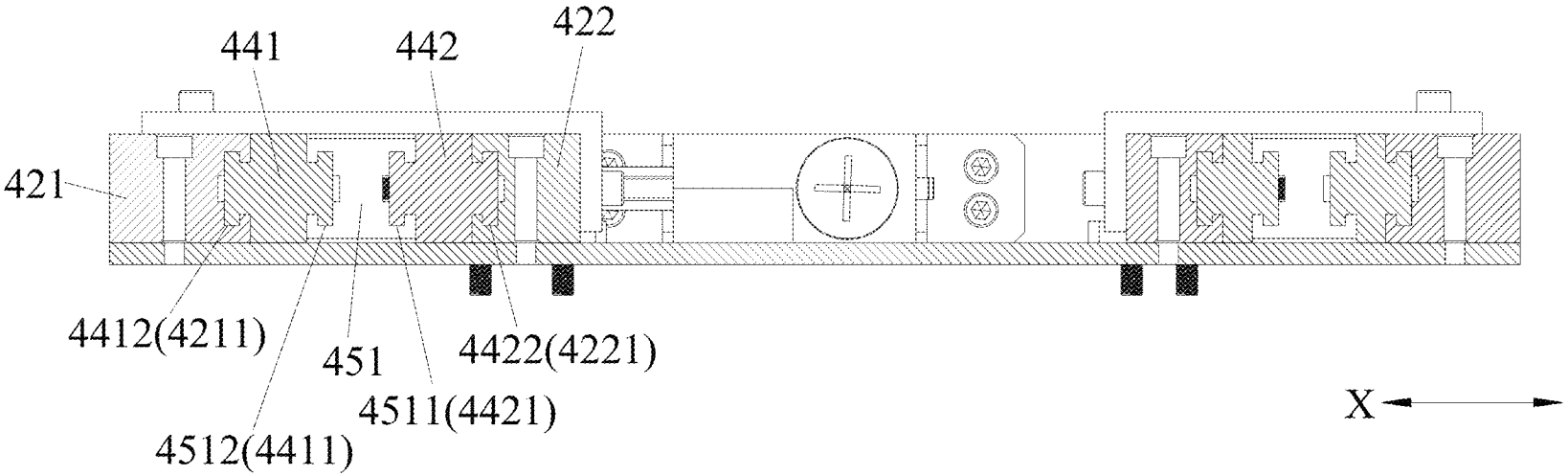
FIG. 14 is a sectional view taken along line XIV-XIV of FIG. 13.

Referring to FIGS. 12 to 14, a one-way retractable building formwork apparatus according to the fifth embodiment of the present disclosure is shown to be identical to the first embodiment, but differs in that, in the fifth embodiment, the retractable unit 4' includes two fixed plate assemblies 42', two connecting bar assemblies 44, and two slide bar assemblies 45. The side bar modules 41 (see FIG. 1) are omitted in this embodiment. For the convenience of description, only one of each of the fixed plate assemblies 42', the connecting bar assemblies 44 and the slide bar assemblies 45 will be described below.

The fixed plate assembly 42' includes a first fixed plate 421 that extends along the extending direction (Y), that is disposed on one end of the mounting surface 91 which extends along the extending direction (Y) and that is fixed to one end of the first side bar 2, and a second fixed plate 422 that extends along the extending direction (Y), that is spaced apart from and that is located inwardly of the first fixed plate 421 along the lateral direction (X) and that is shorter than the first fixed plate 421. Each of the first and second side plates 421, 422 has a slide groove 4211, 4221 extending along a length thereof and having a T-shaped cross section. The slide grooves 4211, 4221 of the first and second side plates 421, 422 face each other.

The connecting bar assembly 44 includes a first connecting bar 441 and a second connecting bar 442 extending along the extending direction (Y) and located between the first and second fixed plates 421, 422. Each of the first and second connecting bars 441, 442 has an inner rail 4411, 4421 and an outer rail 4412, 4422 respectively provided on two opposite sides thereof that are opposite along the lateral direction (X) and extending along a length thereof. Each of the inner and outer rails 4411, 4421, 4412, 4422 has a T-shaped cross section. The outer rail 4412 of the first connecting bar 441 is slidably inserted into the slide groove 4211 of the first fixed plate 421. The outer rail 4422 of the second connecting bar 442 is slidably inserted into the slide groove 4221 of the second fixed plate 422.

The slide bar assembly 45 of this embodiment includes one slide bar 451 extending along the extending direction (Y) and having an inner groove 4511 and an outer groove 4512 respectively provided on two opposite sides thereof that are opposite along the lateral direction (X) and extending along a length thereof. Each of the inner and outer grooves 4511, 4512 has a T-shaped cross section. The inner groove 4511 is slidably engaged with the inner rail 4421 of the second connecting bar 442, while the outer groove 4512 is slidably engaged with the inner rail 4411 of the first connecting bar 441. Through this, the slide bar 451 is slidable between the first and second connecting bars 441, 442 along the extending direction (Y) to fixedly connect to the second side bar 3.

In other implementations, when the retractable unit 4' includes a plurality of the connecting bar assemblies 44 corresponding to the same fixed plate assembly 42', the connecting bar assemblies 44 are sequentially connected in series from outside to inside. The first and second connecting bars 441, 442 of an outermost one of the connecting bar assemblies 44 are slidably engaged to the respective first and second side plates 421, 422 of the fixed plate assembly 42'. The first and second connecting bars 441, 442 of an inner one of the connecting bar assemblies 44 are slidably engaged to the respective first and second connecting bars 441, 442 of an adjacent outer one of the connecting bar assemblies 44. The slide bar 451 is slidably engaged between the first and second connecting bars 441, 442 of an innermost one of the connecting bar assemblies 44. A slidable connection between the fixed plate assembly 42 and the outermost connecting bar assembly 44, between two adjacent connecting bar assemblies 44, and between the slide bar 451 and the innermost connecting bar assembly 44 are by way of slide groove and slide rail engagement to limit the first and second connecting bars 441, 442 of the connecting bar assemblies 44 and the slide bar 451 to adjust the position thereof only along the extending direction (Y).

In another implementations, the connecting bar assemblies 44 may be omitted, so that the slide bar 451 can be slidably inserted between the first and second side plates 421, 422 of the fixed plate assembly 42. A slidable connection between the slide bar 451 and the first and second side plates 421, 422 is by way of slide groove and slide rail engagement to limit the slide bar 451 to adjust the position thereof only along the extending direction (Y).

Therefore, The fifth embodiment can achieve the same effect as that of the first embodiment. Further, since the slide bars 451 of the slide bar assemblies 45 are retractable relative to the respective connecting bar assemblies 44 or the respective fixed plate assemblies 42, this embodiment is suitable for use with the substrate module 9 having different dimensions.

Figure 15:
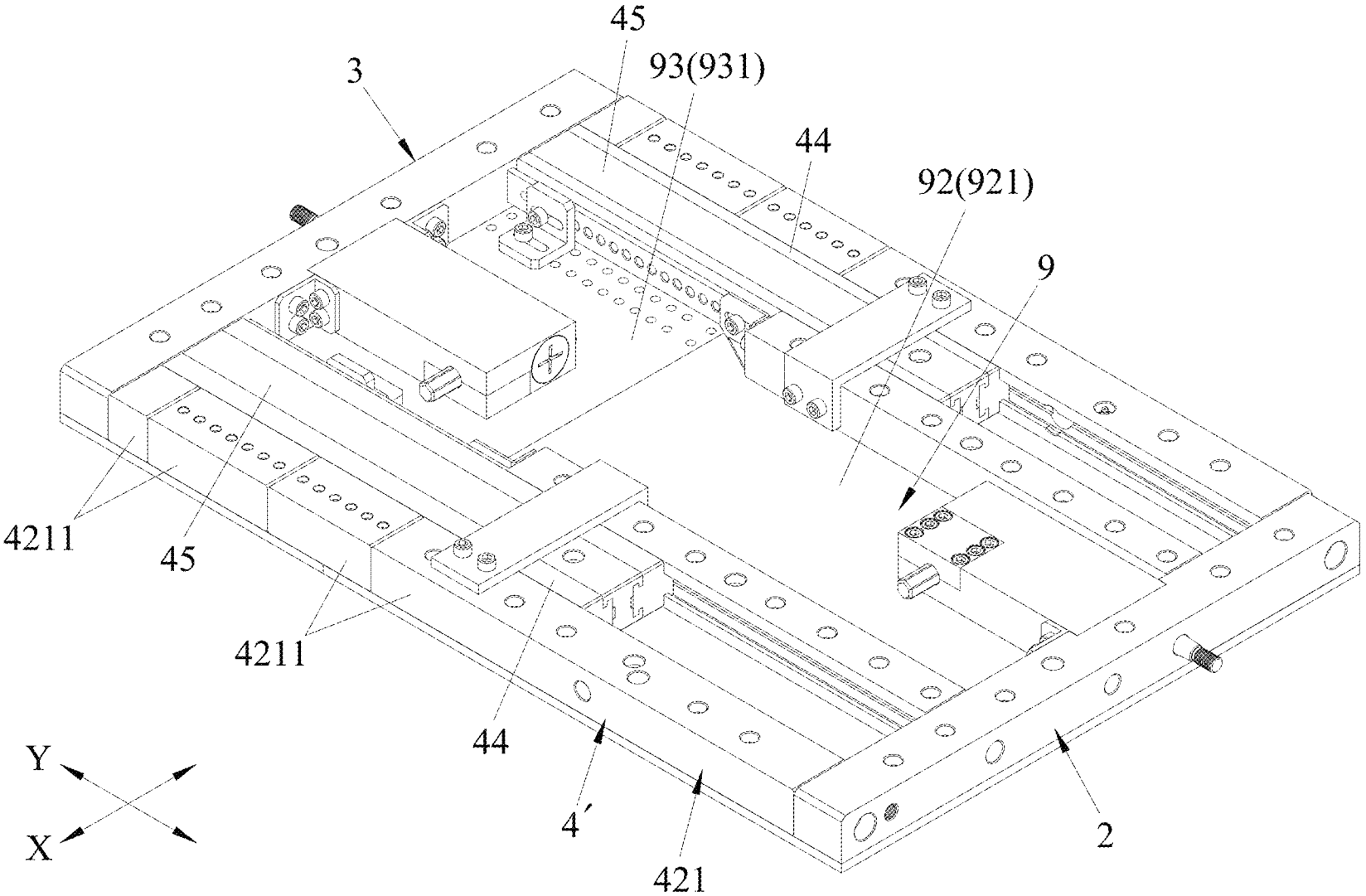
FIG. 15 is a perspective view of a one-way retractable building formwork apparatus according to the sixth embodiment of this disclosure.
Figure 16:
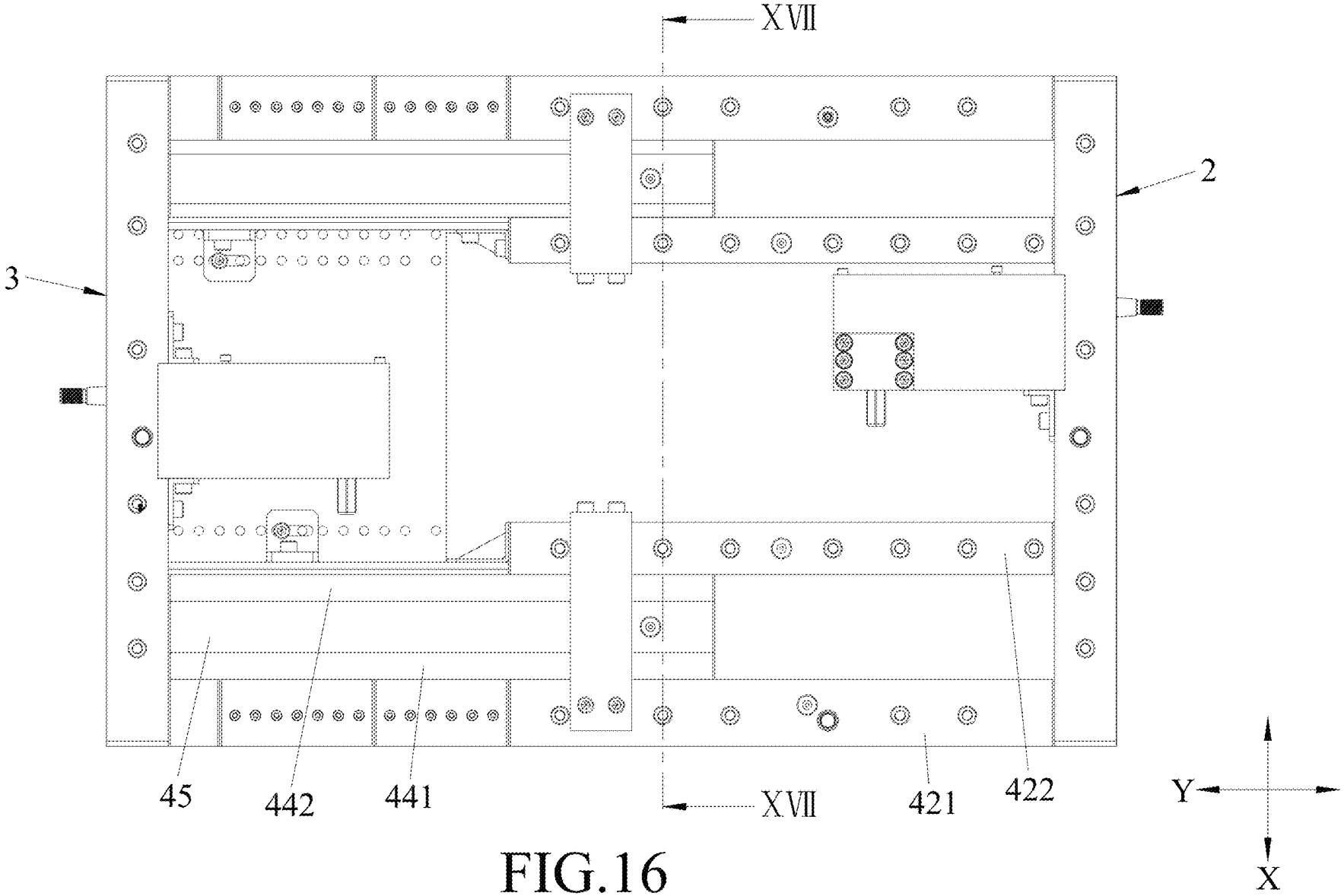
FIG. 16 is a schematic top view of the sixth embodiment.
Figure 17:
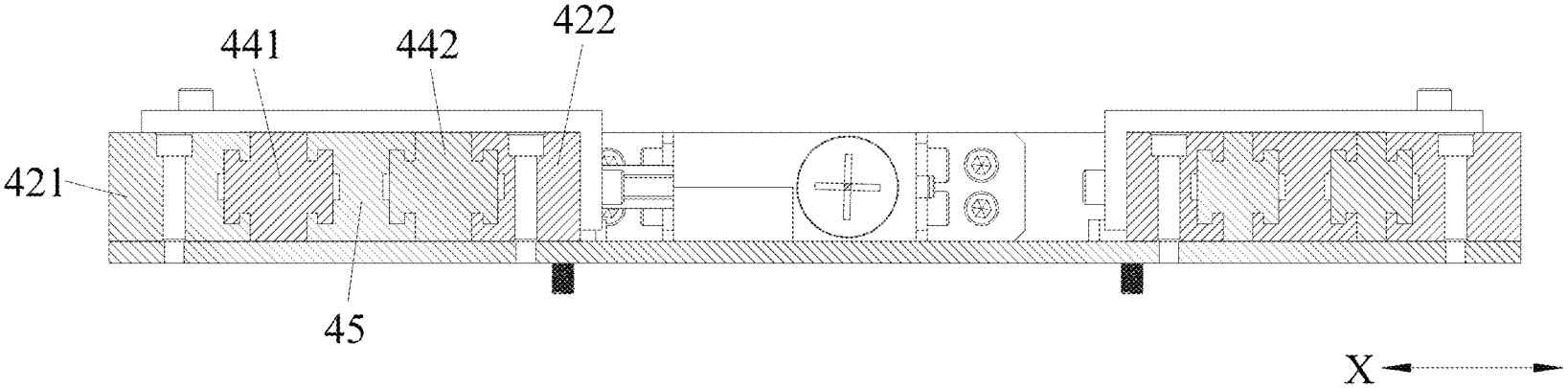
FIG. 17 is a sectional view taken along line XVII-XVII of FIG. 16.

Referring to FIGS. 15 to 17, a one-way retractable building formwork apparatus according to the sixth embodiment of the present disclosure is shown to be identical to the fifth embodiment, but differs in that, in the sixth embodiment, the substrate module 9 includes a first substrate 92 and a second substrate 93 adjacently connected to each other along the extending direction (Y). The first substrate 92 has a first surface 921, while the second substrate 93 has a second surface 931 in the same direction as the first surface 921. The first side bar 2 is disposed on one end of the first surface 921 that extends along the lateral direction (X) and that is distal to the second surface 931. The second side bar 3 is disposed on one end of the second surface 931 that extends along the lateral direction (X) and that is opposite to the first side bar 2 along the extending direction (Y).

The retractable unit 4' is disposed on the first surface 921, and is retractably connected to the second side bar 3. The connecting bar assemblies 44 and the slide bar assemblies 45 of the retractable unit 4' are not extended, and the first fixed plate 421 of each fixed plate assembly 42 includes a plurality of interconnected side plate portions 4211 extending along the extending direction (Y).

Therefore, the sixth embodiment can achieve the same effect as that of the fifth embodiment. Since the substrate module 9 can be formed by splicing multiple substrates and the first fixed plate 421 can also be formed by splicing multiple side plate portions, different lengths of the substrate module 9 and the first fixed plate 421 can thus be made.

In summary, with the retractable unit 4 being retractably connected to the substrate module 9 and the first and second side bars 2, 3, the structure of the substrate module 9 can be strengthened. Further, since the substrate module 9 can be formed by splicing multiple substrates which can be made of leftover materials from the previous projects, and since the side bar modules 41 can also be formed by splicing multiple extension side bars which can be made of leftover materials from the previous projects, in comparison with the existing building formwork apparatus which must spend labor and material costs for customizing the existing building formwork apparatus and the leftover material thereof cannot be reused, the one-way retractable building formwork apparatus of the present disclosure can achieve the effect of cost reduction. Therefore, the object of this disclosure can indeed be achieved.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, said one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A one-way retractable building formwork apparatus for mounting on a mounting surface of a substrate module, comprising:

a first side bar configured to be disposed on one end of the mounting surface that extends along a lateral direction;

a second side bar configured to be disposed on another end of the mounting surface and opposite to said first side bar along an extending direction transverse to the lateral direction; and a retractable unit configured to be disposed on the mounting surface and connected to said first side bar, said retractable unit being extendable along the extending direction to fixedly connect to said second side bar;

wherein said retractable unit includes:

two side bar modules extending along the extending direction and configured to be disposed on another two opposite ends of the mounting surface that extend along the extending direction such that said side bar modules are opposite to each other along the lateral direction, said side bar modules being fixedly connected to said first side bar, a fixed plate assembly configured to be disposed on the mounting surface between said first side bar and said second side bar, and a side plate assembly inserted into said fixed plate assembly and extendable out of said fixed plate assembly along the extending direction to fixedly connect to said second side bar, said side plate assembly including a plurality of side plates telescopically connected to one another, an outermost one of said side plates being slidably engaged with said fixed plate assembly, an innermost one of said side plates being slidably engaged with and being extendable out of an adjacent one of said side plates to fixedly connect to said second side bar.

2. The one-way retractable building formwork apparatus as claimed in claim 1, wherein a slidable connection between said outermost one of said side plates and said fixed plate assembly and between each two adjacent ones of said side plates are by way of slide groove and slide rail engagement to limit said side plates to adjust the position thereof only along the extending direction.

3. The one-way retractable building formwork apparatus as claimed in claim 1, further comprising a side connection unit which includes a plurality of side connectors and a plurality of fixing screws, each of said side connectors including a base plate configured to be disposed on the mounting surface, and a vertical plate extending upwardly from one end of said base plate and adjacent to said side plate assembly, some of said fixing screws being respectively inserted through said base plates of said side connectors to fix said base plates to the mounting surface, the other ones of said fixing screws being respectively inserted through said vertical plates of said side connectors and threadedly connected to said side plates to fix said side plates thereto along the lateral direction.

4. The one-way retractable building formwork apparatus as claimed in claim 1, further comprising a side connection unit which includes a plurality of side connectors and a plurality of fixing screws, each of said side connectors including a base plate configured to be disposed on the mounting surface, and a vertical plate extending upwardly from one end of said base plate and adjacent to said side plate assembly, some of said fixing screws being respectively inserted through said base plates of said side connectors to fix said base plates to the mounting surface, the other ones of said fixing screws being respectively inserted through said vertical plates of said side connectors and threadedly connected to said side plate assembly to fix said vertical plates thereto along the lateral direction.

5. The one-way retractable building formwork apparatus as claimed in claim 1, wherein each of said side bar modules includes a main side bar extending along the extending direction and fixedly connected to one end of said first side bar, at least one extension side bar extending along the extending direction and connected to said main side bar at a side opposite to said first side bar, and a plurality of side bar screws inserted through said at least one extension side bar along the extending direction and screwed to said main side bar.

6. A one-way retractable building formwork apparatus for mounting on a mounting surface of a substrate module, comprising:

a first side bar configured to be disposed on one end of the mounting surface that extends along a lateral direction;

a second side bar configured to be disposed on another end of the mounting surface and opposite to said first side bar along an extending direction transverse to the lateral direction; and a retractable unit configured to be disposed on the mounting surface and connected to said first side bar, said retractable unit being extendable along the extending direction to fixedly connect to said second side bar;

wherein said retractable unit includes:

a fixed plate assembly configured to be disposed on the mounting surface and including a first fixed plate that extends along the extending direction, that is configured to be disposed on one end of the mounting surface along the extending direction, and that is fixed to one end of said first side bar, and a second fixed plate that extends along the extending direction, that is spaced apart from and that is located inwardly of said first fixed plate along the lateral direction; and a slide bar assembly including at least one slide bar that extends along the extending direction and that is slidable between said first fixed plate and said second fixed plate to fixedly connect to said second side bar; and wherein a slidable connection between said at least one slide bar and said first fixed plate and said second fixed plate is by way of slide groove and slide rail engagement to limit said at least one slide bar to adjust the position thereof only along the extending direction.

7. A one-way retractable building formwork apparatus for mounting on a mounting surface of a substrate module, comprising:

a first side bar configured to be disposed on one end of the mounting surface that extends along a lateral direction;

a second side bar configured to be disposed on another end of the mounting surface and opposite to said first side bar along an extending direction transverse to the lateral direction; and a retractable unit configured to be disposed on the mounting surface and connected to said first side bar, said retractable unit being extendable along the extending direction to fixedly connect to said second side bar;

wherein said retractable unit includes:

a fixed plate assembly configured to be disposed on the mounting surface and including a first fixed plate that extends along the extending direction, that is configured to be disposed on one end of the mounting surface which extends along the extending direction, and that is fixed to one end of said first side bar, and a second fixed plate that extends along the extending direction, that is spaced apart from and that is located inwardly of said first fixed plate along the lateral direction;

at least one connecting bar assembly including a first connecting bar and a second connecting bar extending along the extending direction and located between said first fixed plate and said second fixed plate, said first connecting bar being slidably engaged with said first fixed plate, said second connecting bar being slidably engaged with said second fixed plate; and a slide bar assembly including at least one slide bar that extends along the extending direction and that is slidable between said first connecting bar and said second connecting bar to fixedly connect to said second side bar.

8. The one-way retractable building formwork apparatus as claimed in claim 7, wherein a slidable connection between said first connecting bar and said first fixed plate, between said second connecting bar and said second fixed plate, and between said at least one slide bar and said at least one connecting bar assembly are by way of slide groove and slide rail engagement to limit said at least one connecting bar assembly and said at least one slide bar to adjust the position thereof only along the extending direction.

* * * * *